US006761576B1

(12) United States Patent
Ye et al.

(10) Patent No.: US 6,761,576 B1
(45) Date of Patent: Jul. 13, 2004

(54) INSULATION DISPLACEMENT CONTACT CONNECTOR

(75) Inventors: Hui Ye, Kunsan (CN); Ren-Chih Li, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/423,413

(22) Filed: Apr. 24, 2003

(30) Foreign Application Priority Data

Jan. 15, 2003 (TW) ..... 92200668 U

(51) Int. Cl.[7] ..... H01R 11/20
(52) U.S. Cl. ..... 439/404; 439/435
(58) Field of Search ..... 439/404–406, 439/409, 426, 435

(56) References Cited

U.S. PATENT DOCUMENTS 5,100,342 A * 3/1992 Olsson ..... 439/497
5,762,513 A * 6/1998 Stine ..... 439/358
5,967,832 A * 10/1999 Ploehn ..... 439/497
6,120,319 A 9/2000 Lee et al.
6,193,545 B1 2/2001 Lee et al.
6,309,243 B1 * 10/2001 Tu et al. ..... 439/497

* cited by examiner

*Primary Examiner*—Hien Vu
(74) *Attorney, Agent, or Firm*—Wei Te Chung

(57) ABSTRACT

An insulation displacement contact (IDC) connector (1) includes a housing (10) receiving a plurality of contacts (11), a cover (12) and a locking member (13). The cover has two latches (121) at opposite ends thereof, and the locking member has two arms (131) at opposite ends thereof. The housing has two receptacles (101) at opposite ends thereof. Each receptacle includes an inner wall, two parallel sidewalls (1011) extending from the inner wall, and an outer wall (1012) interconnecting the two sidewalls. Each outer wall has two gaps (1013) respectively adjacent the sidewalls and spanning from a bottom edge thereof to a middle section thereof, for providing the outer wall with better elasticity. The latches and the arms insert into the receptacles with the outer walls elastically deforming, thereby establishing electrical connection between tails of the contacts and a determined section of a flat cable, while not damage the outer wall.

6 Claims, 4 Drawing Sheets

INSULATION DISPLACEMENT CONTACT CONNECTOR

BACKGROUND OF THE INVENTION

1. Field of the Invention

The present invention relates to an insulation displacement contact (IDC) connector, and particularly to an IDC connector which can properly position a flat cable therein with minimal risk of damage the IDC connector.

2. Description of the Prior Art

Insulation displacement contact (IDC) connectors, also known as flat cable connectors or ribbon cable connectors, are widely used to mount cables in a cable assembly and thereby transmit signals between computers and peripheral devices. Generally, the flat cable consists of a plurality of parallel conductive cable lines. Each line is enclosed in a sheath made of an insulative material, such as plastic. An IDC connector, such as that disclosed in U.S. Pat. Nos. 6,120,319 and 6,193,545, is commonly used to terminate the flat cable by piercing the corresponding sheath of each line. Referring to FIG. 4, a conventional IDC connector 6 comprises a housing 60, a plurality of electrical contacts 61 received in the housing 60, an insulative cover 63, and a locking member 62.

The housing 60 comprises a main body portion 601, and a pair of receptacles 604 at opposite ends of the body portion 601 respectively. Each receptacle 604 comprises an inner wall 6043, two parallel sidewalls 6041 extending from the inner wall 6043, and an outer wall 6040 interconnecting the two sidewalls 6041 and being opposite from the inner wall 6043. A wedge 6045 is formed on a lower portion of the inner wall 6043. The contacts 61 are received in the body portion 601 of the housing 60. Each contact 61 comprises a forked tail 610 protruding out from a top of the body portion 601. The cover 63 has two U-shaped latches 630 depending from opposite ends thereof respectively, and the locking member 62 has a pair of arms 620 depending from opposite ends thereof respectively.

When the IDC connector 6 is assembled with a flat cable (not shown), firstly, the latches 630 of the cover 63 are inserted into the corresponding receptacles 604 of the housing 60, with the latches 630 engaging with the wedges 6045. The cover 63 and the housing 60 define a receiving space therebetween for receiving a predetermined section of the flat cable. In this process, the forked tails 610 of the contacts 61 pierce the sheaths of the flat cable, and thereby electrically connect with the flat cable. Then the flat cable is folded back over onto a top of the cover 63. The arms 620 of the locking member 62 are inserted into the corresponding receptacles 604, and engagingly abut against the outer walls 6040.

However, when the arms 620 are inserted into the receptacles 604, the outer walls 6040 are liable to substantially deform or even break due to compression from the arms 620. Yet if a space between each inner wall 6043 and its corresponding outer wall 6040 is increased to reduce deformation of the outer wall 6040, the corresponding arm 620 is liable to only loosely clasp the outer wall 6040.

In view of the above, a new IDC connector that overcomes the above-mentioned disadvantages is desired.

SUMMARY OF THE INVENTION

Accordingly, an object of the present invention is to provide an insulation displacement contact (IDC) connector which can reliably connect with a flat cable with minimal risk of damage to the IDC connector.

To achieve the above-mentioned object, an insulation displacement contact (IDC) connector in accordance with a preferred embodiment of the present invention comprises an insulative housing, a plurality of electrical contacts received in the housing and protruding out from a top of the housing, an insulative cover and a locking member. The housing comprises a body portion and two receptacles at opposite ends of the body portion. Each receptacle comprises an inner wall, two parallel sidewalls extending from the inner wall, and an outer wall interconnecting the two sidewalls. Each of the outer walls defines two gaps respectively adjacent the sidewalls for providing the outer wall with better elasticity. Each gap spans from a bottom edge of the outer wall to a middle section of the outer wall, and has a determined height. The cover has two U-shaped latches depending from opposite ends thereof respectively, and the locking member has two arms depending from opposite ends thereof respectively. The latches and the arms insert into the receptacles with the outer walls elastically deforming, thereby the cover and the locking member engaging with the housing in order to force the forked tails of the contacts to electrically connect with a determined section of a flat cable, while not damage the outer walls of the receptacles.

Other objects, advantages and novel features of the invention will become parent from the following detailed description when taken in conjunction accompanying drawings, in which:

DETAILED DESCRIPTION OF THE PREFERRED EMBODIMENT OF THE INVENTION

Reference will now be made to the drawings to describe the present invention in detail.

Figure 1:
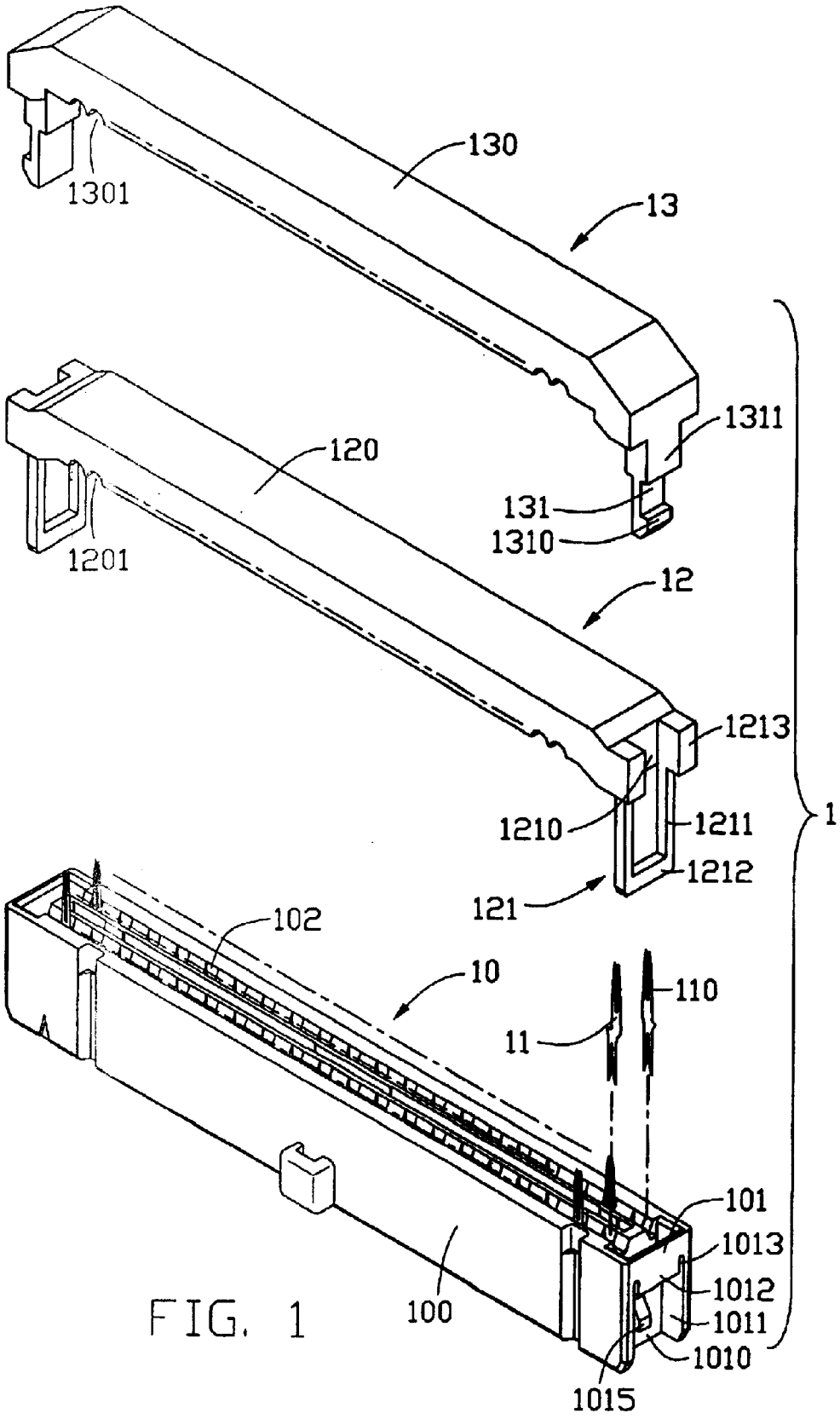
FIG. 1 is a simplified, exploded isometric view of an IDC connector in accordance with the preferred embodiment of the present invention.
Figure 2:
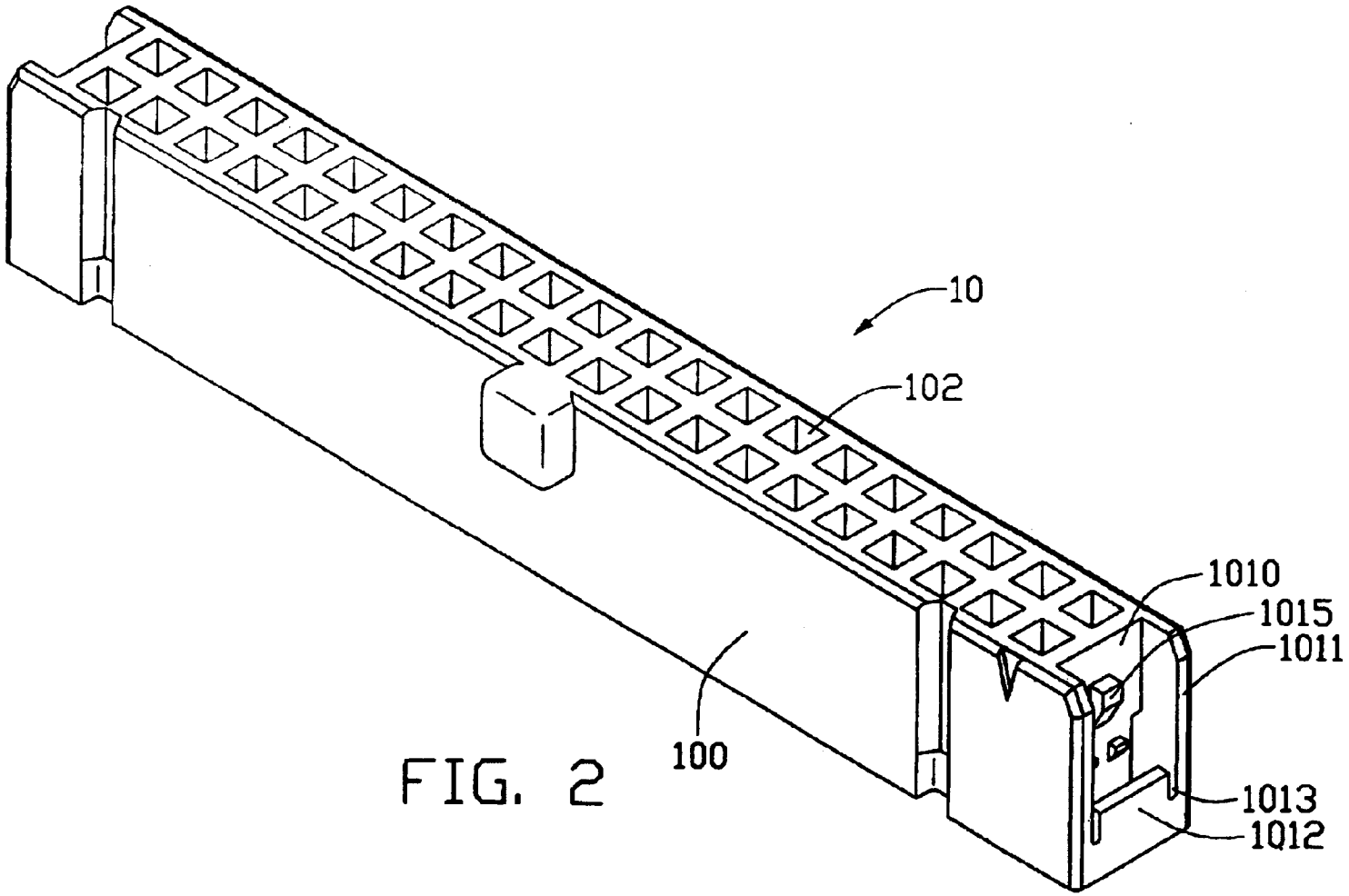
FIG. 2 is an isometric view of a housing of the IDC connector of FIG. 1, but showing the housing inverted.

An insulation displacement contact (IDC) connector 1 of the present invention is used to electrically connect with a flat cable (not shown) for transmitting signals between computers and peripheral devices. The flat cable comprises a plurality of cable lines each having a conductive core and an insulative sheath around the core. The flat cable has a pre-determined section (hereafter referred to as an engaging section) for engaging with the IDC connector 1. Referring to FIGS. 1 and 2, the IDC connector 1 comprises an insulative housing 10, a plurality of electrical contacts 11 received in the housing 10, an insulative cover 12 and a locking member 13.

The housing 10 is elongate, and comprises a main body portion 100 and two receptacles 101 at opposite ends of the body portion 100 respectively.

Each receptacle 101 comprises an inner wall 1010, two parallel sidewalls 1011 extending from the inner wall 1010, and an outer wall 1012 interconnecting the two sidewalls 1011 and being opposite from the inner wall 1010. The outer wall 1012 defines two parallel gaps 1013 respectively adjacent the sidewalls 1011, for providing the outer wall 1012 with better elasticity. Each gap 1013 spans from a bottom edge of the outer wall 1012 to a middle section of the outer wall 1012, and has a pre-determined height. A wedge 1015 is formed on a lower section of the inner wall 1010. The wedge 1015 has a bottom engaging surface that is perpendicular to the inner wall 1010.

The body portion 100 defines two rows of spaced passageways 102 in a longitudinal direction thereof. The contacts 11 are received in the passageway 102 respectively. Each contact 11 has a forked tail 110 extending from within the passageway 102 and protruding out from a top of the body portion 100.

The cover 12 comprises an elongate bridging portion 120, and a pair of latches 121 depending from opposite ends of the bridging portion 120 respectively. The bridging portion 120 has a bottom face defined with a plurality of arcuate grooves 1201, for receiving the engaging section of the flat cable. Each latch 121 has a U-shaped structure, comprising two legs 1211 substantially parallel to each other, and a beam 1212 interconnecting bottoms of the legs 1211. The legs 1211 and beam 1212 cooperatively define a channel 1210 therebetween. Each leg 1211 has a stop 1213 projecting outwardly from a top section thereof.

The locking member 13 has a generally U-shaped structure, comprising an intermediate portion 130 and two arms 131 depending from opposite ends of the intermediate portion 130. The intermediate portion 130 has a bottom face defined with a plurality of arcuate grooves 1301, similar to the grooves 1201 of the cover 12. Each arm 131 has a clasp 1310 at a bottom end thereof, and a protrusion 1311 projecting outwardly from an upper section thereof.

When assembling the flat cable into the IDC connector 1, a first configuration is obtained, and then a second and final configuration is obtained.

Figure 3:
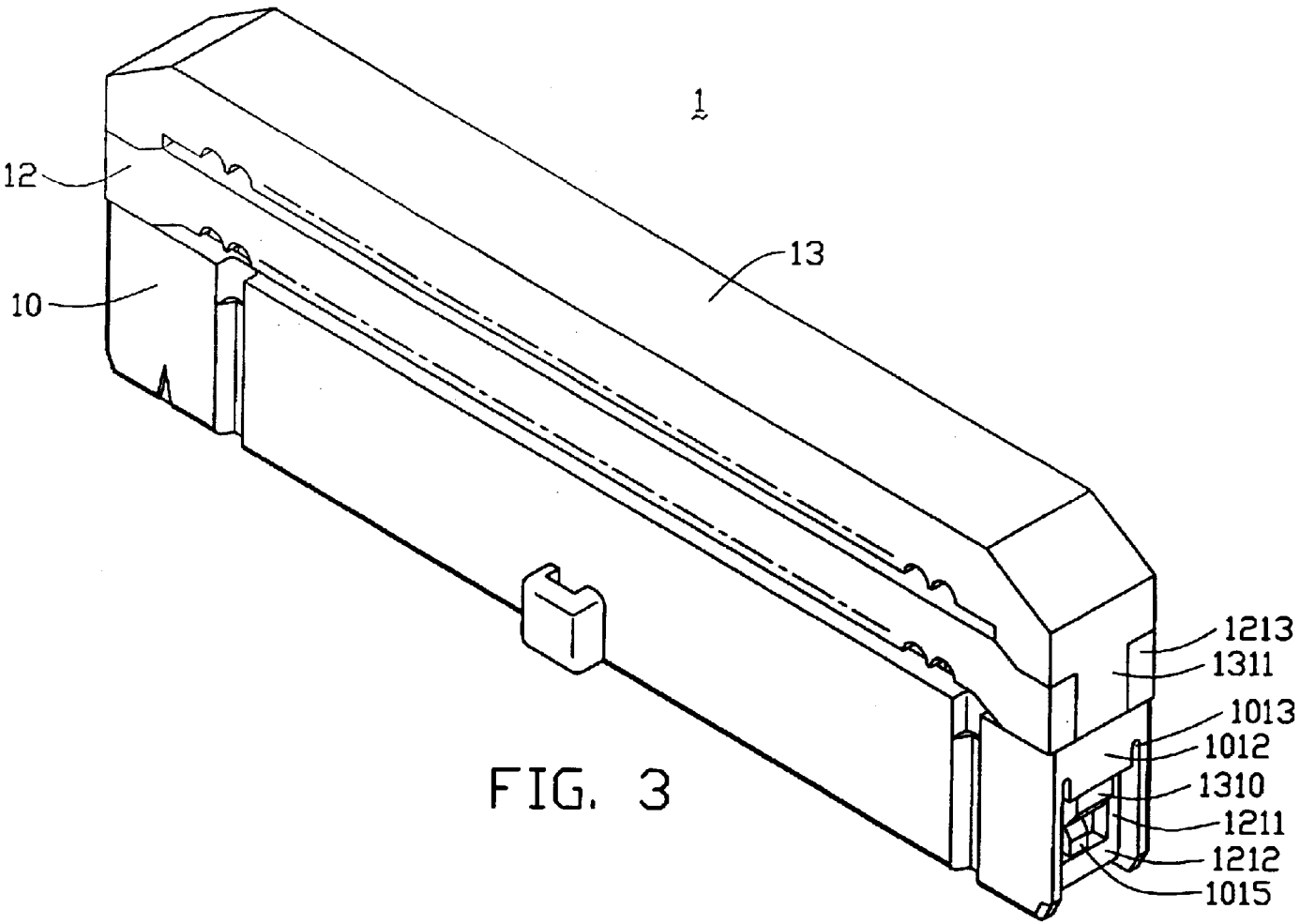
FIG. 3 is an assembled view of FIG. 1.
Figure 4:
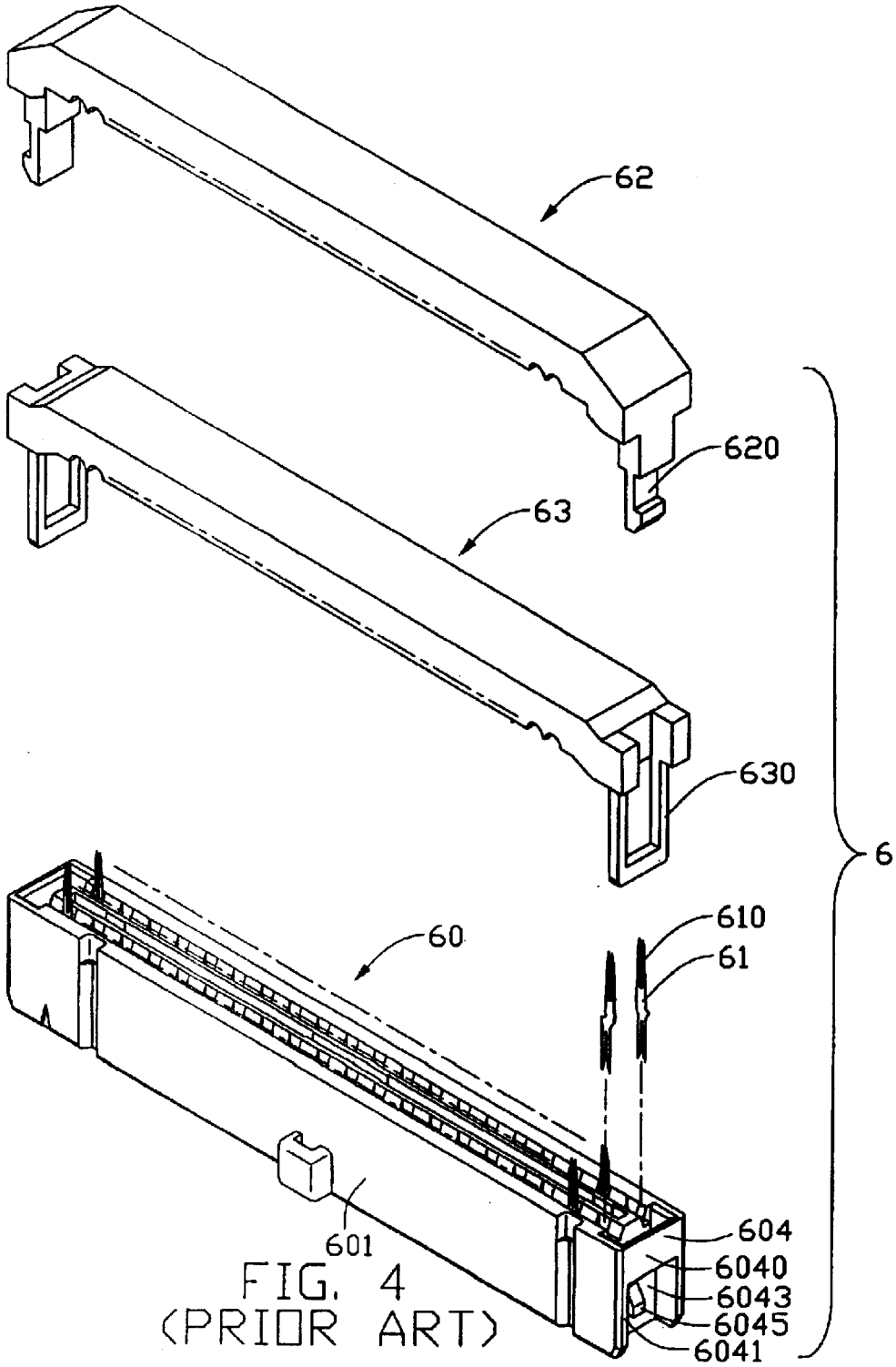
FIG. 4 (PRIOR ART)
FIG. 4 is a simplified, exploded isometric view of a conventional IDC connector.

Referring to FIG. 3, firstly, the engaging section of the flat cable is attached on the tails 110 of the contacts 11. The latches 121 of the cover 12 are inserted into the receptacles 101 of the housing 10. The latches 121 are pressed downwardly until the stops 1213 of the latches 121 abut against top edges of the outer walls 1012, and the beams 1212 of the latches 121 firmly engage with the engaging surfaces of the corresponding wedges 1015 of the receptacles 101. In this process, the engaging section of the flat cable is positioned between the grooves 1201 of the cover 12 and the tails 110 of the contacts 11, and the tails 110 pierce the sheaths of the flat cable and electrically connect with respective conductive cores of the flat cable. At this stage, the assembly has attained said first configuration.

Then the flat cable is folded back over onto a top of the bridging portion 120 of the cover 12. The locking member 13 is mounted onto the flat cable. The arms 131 of the locking member 13 are inserted into the channels 1210 of the latches 121 of the cover 12. The arms 131 continue traveling into the receptacles 101, with the outer walls 1012 elastically deforming to allow passage of the clasps 1310 of the arms 131 therealong. Thus the outer walls 1012 merely deform without sustaining damage. The clasps 1310 eventually snappingly clasp the bottom edges of the outer walls 1012, and simultaneously the protrusions 1311 abut against the top edges of the outer walls 1012. As a result, the relevant part of the flat cable is firmly retained between the top of the bridging portion 120 of the cover 12 and the bottom face of the locking member 13 at the waved grooves 1301. At this stage, the assembly has attained said second and final configuration.

An elasticity of each outer wall 1012 increases proportionately with an increasing height of the two corresponding gaps 1013. On the other hand, stable retention of the corresponding clasp 1310 of the locking member 13 and the bottom edge of the outer wall 1012 decreases proportionately with an increasing height of the two corresponding gaps 1013. Therefore, in practice, a preferred height of the gaps 1013 is 0.81~1.2 mm when a height of the outer wall 1012 is 2.95 mm. It should be understood, however, that the height of the gaps 1013 may vary according to the particular height of the outer wall 1012, and according to the particular material which the outer wall 1012 comprises.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An insulation displacement contact (IDC) connector, comprising:

an insulative housing comprising a main body portion and a pair of receptacles at opposite ends of the body portion, the body portion defining a plurality of passageways, each receptacle comprising an inner wall, two parallel sidewalls extending from the inner wall and an outer wall interconnecting the two sidewalls, each outer wall having at least two gaps extending from a bottom edge thereof toward a middle section thereof for providing the outer wall with better elasticity;

a plurality of contacts respectively received in the passageways of the housing;

an insulative cover having a pair of latches depending from opposite ends thereof, each latch being insertable into a corresponding receptacle; and a locking member having a pair of arms depending from opposite ends thereof, each arm having a clasp at an end thereof, each clasp being able to abut against the bottom edge of the corresponding elastic outer wall of the housing;

wherein said at least two gaps respectively adjacent the sidewalls, and each gap has a determined height;

wherein each latch is a U-shaped structure, having two parallel legs with a channel therebetween;

wherein each of the arms has a protrusion at an upper section thereof for engagingly abutting against the top edge of the outer walls.

2. The IDC connector as claimed in claim 1, wherein the height of each gap is 0.8~1.2 mm when the height of the outer wall is 2.95 mm.

3. The IDC connector as claimed in claim 1, wherein a wedge is formed at a lower section of the inner wall for engaging with the corresponding latch of the cover.

4. The IDC connector as claimed in claim 1, wherein each of the legs of the latches has a stop at an upper section thereof for engagingly abutting against a top edge of one of the outer walls.

5. An electrical connector comprising:

an insulative housing having a pair of receptacles at opposite ends thereof, each receptacle comprises an inner wall, two parallel sidewalls extending from the inner wall and an outer wall interconnecting the two sidewalls and being opposite from the inner wall, each outer wall having at least two gaps extending from a bottom edge thereof toward a middle section thereof for providing the outer wall with better elasticity;

a plurality of contacts received in the housing;

an insulative cover positioned on the housing with a pair of U-shaped latches located at two opposite ends thereof and extending into the corresponding receptacles and hooked under the corresponding locking wedges respectively;

a locking member having a pair of hooks depending from opposite ends thereof, each hook being able to insert into the corresponding receptacle for engagingly abutting against the bottom edge of the corresponding elastic outer wall;

wherein each of the arms has a protrusion at an upper section thereof for abutting against a top edge of one of the outer walls; and wherein said the at least two gaps respectively adjacent the sidewalls, and each gap has a determined height.

6. The IDC connector as claimed in claim 5, wherein the height of each gap is 0.81~1.2 mm when the height of the outer wall is 2.95 mm.

* * * * *